US006408529B1

(12) United States Patent
Hodges

(10) Patent No.: US 6,408,529 B1
(45) Date of Patent: Jun. 25, 2002

(54) MULTI-PURPOSE FRAMING SQUARE

(76) Inventor: Sammie Rayfield Hodges, 3005 Landing Cir., Grimesland, NC (US) 27837

( * ) Notice: Subject to any disclaimer, the term of this patent is extended or adjusted under 35 U.S.C. 154(b) by 0 days.

(21) Appl. No.: 09/327,270

(22) Filed: Jun. 7, 1999

(51) Int. Cl.[7] ..... B43L 13/00
(52) U.S. Cl. ..... 33/429; 33/476
(58) Field of Search ..... 33/415, 416, 417, 33/418, 423, 424, 429, 474, 476, 482, 483, 484, 485, 494

(56) References Cited

U.S. PATENT DOCUMENTS

| | | | | | |
|---|---|---|---|---|---|
| 1,179,778 | A | * | 4/1916 | Turner | 33/476 |
| 1,196,519 | A | * | 8/1916 | Caylor | 33/476 |
| 1,579,137 | A | * | 3/1926 | Pecker | 33/476 |
| D197,302 | S | * | 1/1964 | Schimmelman | D52/6 |
| 3,456,353 | A | * | 7/1969 | Iams | 33/429 |
| D220,061 | S | * | 3/1971 | Kerns | D52/6 |
| 4,394,801 | A | * | 7/1983 | Thibodeaux | 33/496 |
| 4,506,451 | A | * | 3/1985 | Hiltz | 33/451 |
| 4,574,492 | A | * | 3/1986 | Miller | 33/427 |
| 4,598,482 | A | * | 7/1986 | Castleton | 33/482 |
| 4,641,435 | A | * | 2/1987 | Brown | 33/427 |
| 4,745,689 | A | * | 5/1988 | Hiltz | 33/451 |
| 5,170,568 | A | * | 12/1992 | Wright | 33/480 |
| 5,253,426 | A | * | 10/1993 | Mosbrucker | 33/429 |
| 5,669,149 | A | * | 9/1997 | Meizler | 33/471 |
| 6,122,834 | A | * | 9/2000 | Rester | 33/474 |

* cited by examiner

*Primary Examiner*—Randy W. Gibson
(74) *Attorney, Agent, or Firm*—Mills Law Firm PLLC

(57) ABSTRACT

A multi-purpose framing square for 2× dimensional lumber includes an elongate rectangular body with a width of 2× dimensional lumber and an L-shaped crossbar centrally attached at one end. The inner edge of the crossbar establishes a pivot point for rotating the body relative to the lumber. The outer edges of the body include longitudinal scales. The inner edges include radial lines referenced to the pivot points for establishing conventional pitches. A table is provided on the faces for establishing the rafter lengths for various roof pitches.

8 Claims, 2 Drawing Sheets

MULTI-PURPOSE FRAMING SQUARE

FIELD OF THE INVENTION

The present invention relates to carpentry tools, and in particular, to framing tools having integral measuring, marking and tabular information for enabling a worker to establish readily the material required and the layout lines for sizing lumber for use in framing and roof construction.

BACKGROUND OF THE INVENTION

Construction workers and carpenters use a wide variety of layout tools in the erection of various structures. To insure proper perpendicularity and angularity such that adjacent members are correctly aligned, framing squares and levels and gages are commonly employed. Most widely used is a carpentry framing square. The typical framing square is a single L-shaped piece of material having unequal legs having indicia at periodic markings to indicate incremental lengths. Levels may be integrated with such tools. While simple in construction, framing squares cannot be readily used to plumb studs or layout rafters for roofing. Moreover, framing squares are bulky, generally 12 inch by 24 inch or larger, and cannot be carried in an ordinary tool belt. Additionally, for roofing in particular, the size effectively prevents using the framing square during construction to check and verify the correctness of the layouts. While seeking to provide gage markings for additional carpentry tasks, angular indicia, compound cut markings and the like have been included in multi-purpose framing tools, this multiplicity of information is oftentimes confusing, unneeded or inherently provided by the construction tools.

One such approach is disclosed in U.S. Pat. No. 4,506,451 to Hiltz wherein an adjustable mechanical stop is provided to set an associated straight edge at a desired marking inclination. Liquid levels are incorporated for use in aligning 90° and 45° cuts. Discrete stops are required for each inclination. U.S. Pat. Nos. 4,745,689 to Hiltz, 4,922,621 to Maier, D197,309 to Schimmelman and D220,061 to Kerns disclose foldable selectively pivotal arm and straight edge-level tools that can be preset to replicate angular cuts. U.S. Pat. No. 5,669,149 to Meitzler and U.S. Pat. No. 4,394,801 to Thibodeaux disclose another foldable arm tools containing indicia, angular and numeric for establishing varying pitches and cut angles.

Another approach for marking pitch angles is disclosed in U.S. Pat. No. 3,456,353 to lams wherein two sliding pivot buttons that may be adjusted with respect to indicia to establish cutting angles. U.S. Pat. No. 4,574,492 to Miller discloses a layout tool provided with a number of slots and apertures containing configurations, slots and indicia for establishing angular cuts. U.S. Pat. No. 5,253,426 to Mosbrucker discloses a three-section layout square containing angular, pitch length and tabular indicia for use in making pitch and angle framing cuts. Similarly U.S. Pat. No. 5,727,325 to Mussell discloses a triangular multipurpose square that performs various straightedge and protractor orientations.

The foregoing, although in one way or another providing a basis for laying out commonly used construction angles and pitches, provide a multiplicity of superfluous information and tool orientation techniques for establishing the desired cutting lines. In addition to being needlessly complex for the average tradesman, awkward to handle, and cumbersome to carry conveniently on the tool belt around the job site, no information is contained thereon allowing the carpenter to select the proper length of material, conveniently layout the cutting lines, employ current measuring techniques and reference only the information necessary to make the base cuts required with modem construction tools. Additionally, for most construction applications, conventional layout equipment performs satisfactorily. However, in the roof framing field where varying pitches and runs are required in a compound roof design, a simple layout tool enabling the tradesman to select only the information needed to select the proper material and mark the cuts required for the ridge beam, base plate and overhang for convenient carrying on the tool belt around the job site has not yet been available.

SUMMARY OF THE INVENTION

The present invention overcomes the limitations and complexities of the prior art and fulfills the needs for a compact roof framing tool. The resultant multi-purpose roofing framing square is light weight, compact and easy to carry in a conventional tool belt holder, and contains all information necessary for the carpenter to select the proper length of material for a given roof section, mark all necessary cut lines, and saw the desired roofing configurations with a conventional circular saw.

More particularly, the multi-purpose roof framing square of the present invention provides a compact, lightweight, easy to use tool belt framing square containing all information and guide surfaces necessary for enabling the worker to select proper lumber lengths for rafters and beams, mark the correct pitch, establish load bearing notches, and create setoffs and overhangs. The framing square includes an elongated rectangular body having a standard 2× graduated width defined by graduated parallel sides and a length sufficient to mark common lumber widths. A crosspiece is provided at one end of the body orthogonal thereto and wider than the body. Accordingly, the framing square may be traversed along one edge of the lumber piece with the body perpendicular thereto thereby allowing the worker to make accurate markings for transverse cuts with indicia for marking common increments of the 2× dimensional lumber. Additionally, the outboard edge of the ruler is provided with a linear scale for marking incremental lengths. The inboard edge of the ruler is provided with angular indicia representing common roof pitches as measured from the pivot point between the cross piece and the ruler. By setting the pivot point at the desired marking for pitch cut, the ruler is rotated to align the pitch indicia with the longitudinal edge of the stock. The worker can then scribe a cutting line along the outboard edge of the ruler. Further, the framing square contains a table containing rafter lengths per width increment. Inasmuch as the typical worker customarily uses a calculator in normal activities, the length of the rafter for a particular run and pitch may be readily determined thereby quickly providing an indication of the minimum length required in each instance. Standard setoffs and overhangs may be easily added thereto in the calculation. Such length calculation may also be used to layout the "birdsmouth" notches from mounting the rafter to the top plate of the supporting wall. The above calculated rafter run is transcribed from the outboard tip of the rafter to the inboard edge thereof, a transverse line at the desired pitch transcribed therefrom, and a line transcribed at right angles thereto having a length for the support base conforming to applicable building codes. After marking and cutting one such rafter, the finished rafter may be used for making all similar rafter units.

It will thus be appreciated that with a single tool, lightweight and easy to carry in conventional tool pouches, the worker is provided with the information and tools required for laying out and cutting the various building roofing conditions experienced in the normal course of trade.

Accordingly, it is an object of the present invention to lightweight, easy to carry framing square containing a simplified layout format for marking and cutting lumber used in framing and roof.

Another object of the invention is a framing square for 2× dimensional lumber construction including scales and tables for establishing cutting lines at the desired lengths and angularity for conventional framing construction.

A further object of the invention is to provide a lightweight tool belt accessory for marking and cutting dimensional lumber to desired configurations in combination with tools ordinarily used by workers in the trade.

BRIEF DESCRIPTION OF THE DRAWINGS

The above and other objects and advantages of the present invention will become apparent upon reading the following detailed description taken in conjunction with the accompanying drawings in which.

DETAILED DESCRIPTION OF THE PREFERRED EMBODIMENT

Figure 1:
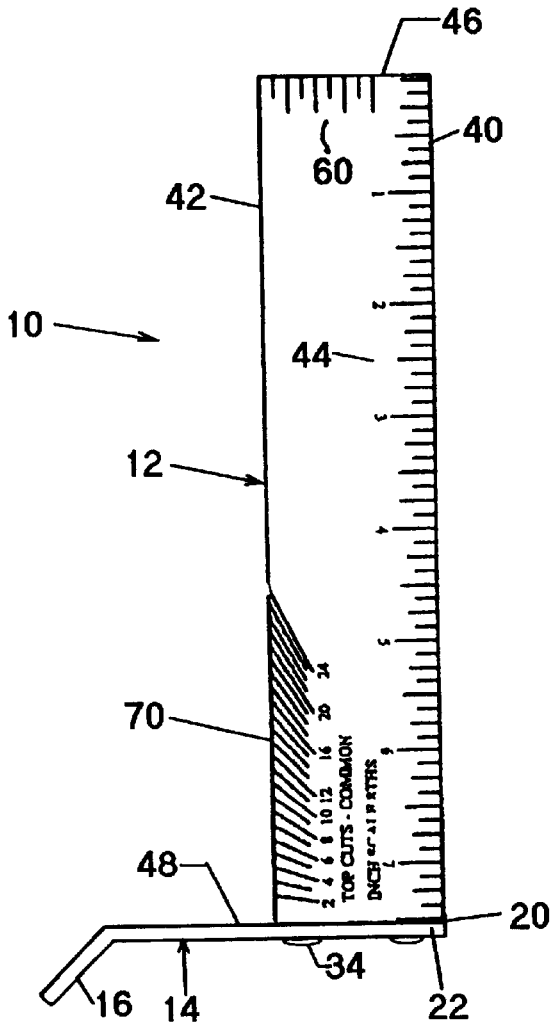
FIG. 1 is a front elevational view of a multi-purpose framing square in accordance with the invention.
Figure 2:
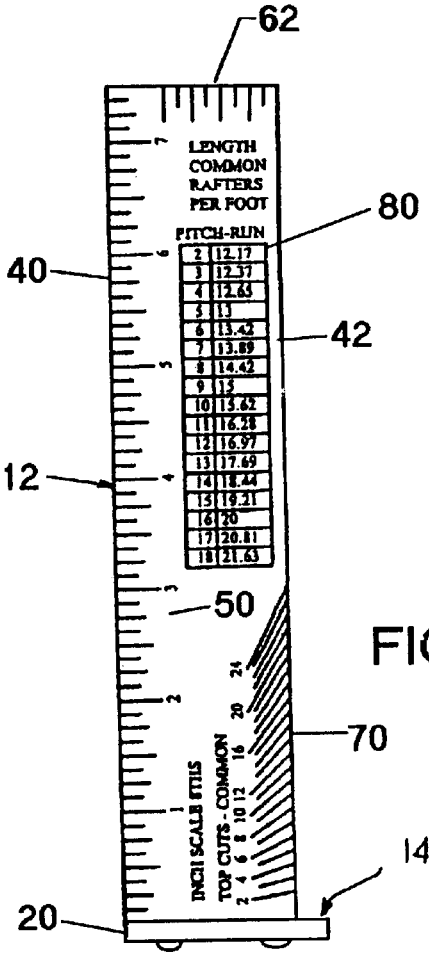
FIG. 2 is a rear elevational view of the framing square of FIG. 1.

Referring to the drawings for purposes of illustrating a preferred embodiment of the invention and not for limiting same, FIGS. 1 and 2 show a multi-purpose framing square 10 useful as hereinafter described in greater detail for laying out the various cuts required for the framing and roofing members typically used in the construction of residential and commercial structures. The framing square 10 in conjunction with ordinary equipment customarily carried by workers such as markers, saws (electrical and manual), measures and calculators will enable the worker to quickly mark workpieces on-site as to length, pitch and configuration.

More particularly, the framing square 10 is generally L-shaped and comprises an elongated, rectangular scale body 12 having a cross bar 14 fixedly attached to the lower end thereof and extending perpendicularly thereto from flush with one longitudinal edge and outwardly from the opposed lateral edge. The framing square 10 is particularly adapted for use with conventional 2× dimensional lumber framing members such as 2×4, 2×6, 2×8 and like lumber sizes and will be described with reference thereto.

Accordingly, the rule section is preferably a 2× width of 1½ inches and 7½ inches thereby directly accommodating 2×8, however it will be appreciated that all cutting lines may be conveniently extended for the layout of larger sizes. The scale body 12 is formed of a suitable material such as aluminum at a thickness of about ⅛ to 3⁄16 inch. It will be apparent that other relative sizes and materials will likewise satisfy the foregoing objectives. So configured, the framing square 10 is lightweight and sized for convenient retention in conventional tool holders.

Figure 3:
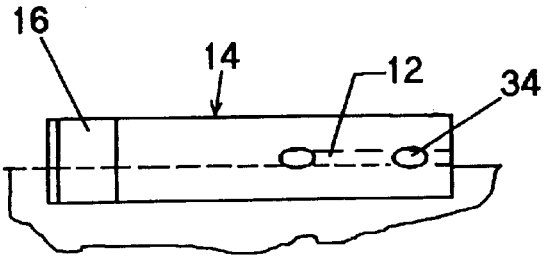
FIG. 3 is a bottom view of the framing square of FIG. 1.
Figure 6:
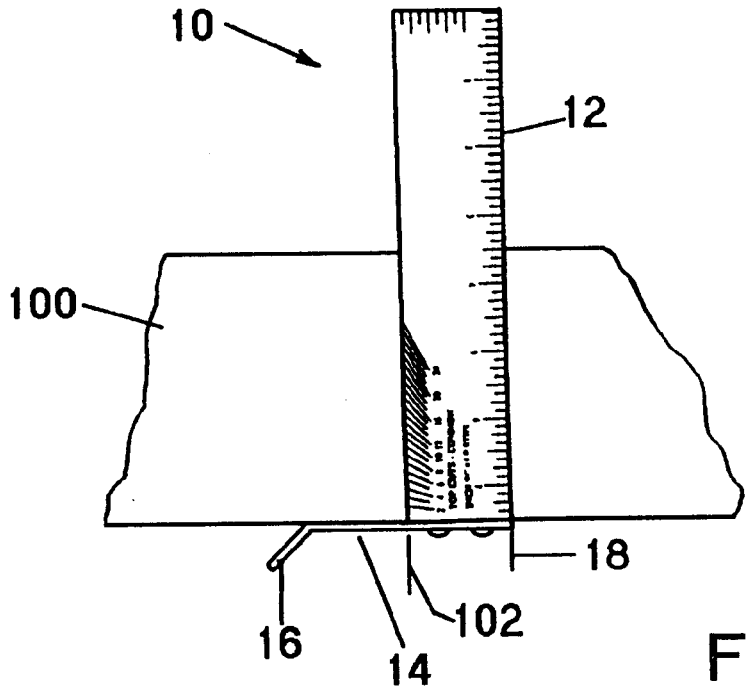
FIG. 6 is a plan view of the framing square illustrating the layout of transverse cuts.
Figure 7:
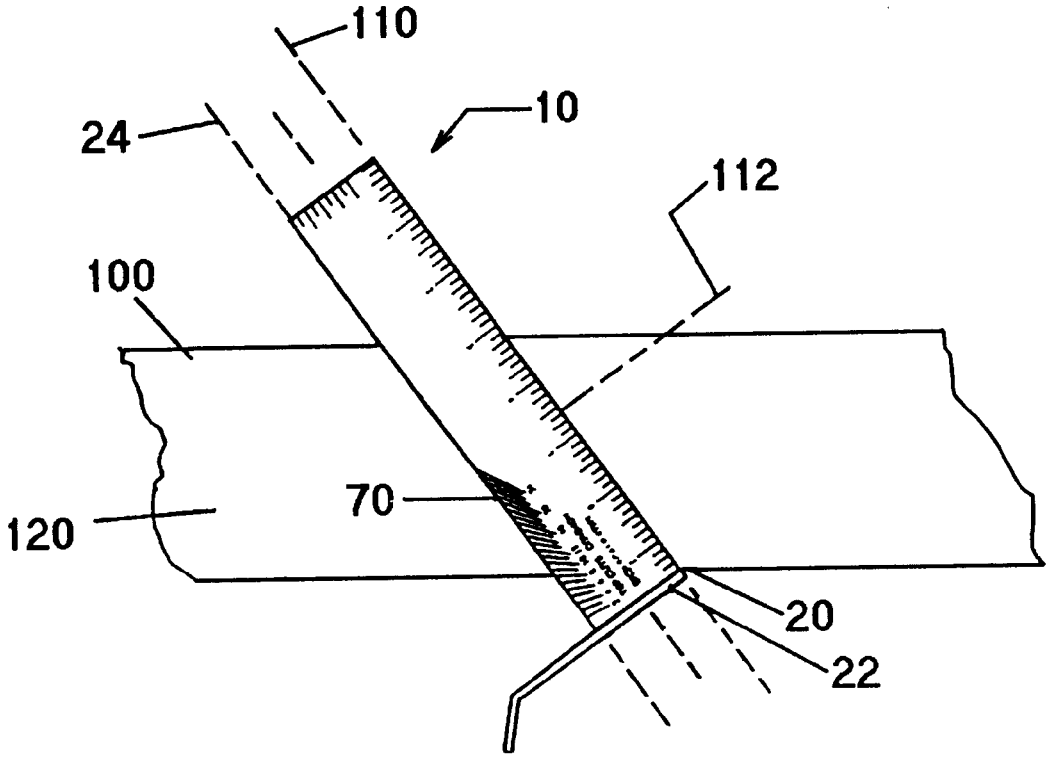
FIG. 7 is a plan view of the framing square illustrating the layout of birdsmouth, setoff, and peak cuts.

The crossbar 14 as shown in FIG. 3 is centrally laterally positioned with respect to the base of the scale body 12 and has a width of about ¾ inch, a length of about 3 inches, and a thickness of about ⅛ to 3⁄16 inch. The distal end 16 of the crossbar 14 is bent downwardly at a discrete angle of 45° for additional use in the layout of common angles. As shown in FIGS. 3 and 6, the overhang of the crossbar 14 allows the framing square to be traversed along the longitudinal edge of a workpiece for laying out transverse cuts 18. Additionally, as shown in FIG. 7, the framing square may be rotated about a pivot point 20 at the juncture of the proximate end 22 of the cross bar and the outer longitudinal edge of the scale body 12 for lay out of angular markings 24.

Figure 4:
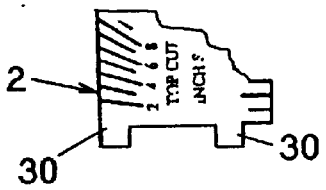
FIG. 4 is a partial side elevational view of the marking section of the framing section prior to assembly.
Figure 5:
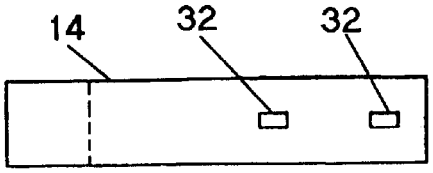
FIG. 5 is a top view of the crossbar of the framing square prior to assembly.

Referring to FIGS. 4 and 5, the lower end of the scale body 12 is provided with downwardly projecting tangs 30. The crossbar 14 is provided with longitudinally spaced, centrally laterally located apertures 32 spaced complementary to the tangs 30. In assembly, the tangs 30 are appropriately cold formed to provide swaged head sections 34 for securing the scale body 12 to the crossbar 14. Obviously, other means for securing the pieces may be used.

The scale body 12 is provided with various indicia and tabular and other data used for determining and scribing length, width and angular relationships for cutting workpieces to size for use in common framing and roofing arrangements. More particularly, the scale body 12 is provided with an outer longitudinal edge 40 and an inner longitudinal edge 42. On the front side outer edge an incremental scale 44 is provided by suitable means such as printing, embossing or the like. The scale 44 originates at the top end 46 of the scale body 12 and terminates at the base end 48. On the other or rear side, the scale 50 is reversed, originating at the base end and terminating at the top end 46. Accordingly a worker is provided with bi-directional indicia for measuring and transcribing transverse distances on the workpiece.

As previously mentioned, the width of the scale body is a 2× increment, or preferably 1½ inches. At the top end 46 of the front side, a width scale 60 is provided originating at the inner edge 42. On the opposite side, the width scale 62 originates at the outer edge 42. Accordingly, a worker may measure or transcribe widths in 2× increments using the edges 40, 42, or partials thereof using the scales 60, 62.

In order to provide ready layout of the pitch angle customarily used in construction, the inner edges of the front and rear faces of the scale body 12 are provided with pitch indicia 70. The indicia 70 are in the form of radial lines originating at the pivot point 20 at the juncture of the proximate end 22 of the cross bar 14 and the outer base of the outer edge 40. The indicia are labeled in common height/length format, such as "X" by 12 wherein X is the rise per foot of length. Typically, the range for such roof pitches is from about a 2 inch to a 24 inch rise per foot of span or length. The indicia provide for the increments thereof.

The rear face of the scale body 12 is also provided with a table 80 containing pitch/run date for calculating the workpiece length required for a particular rafter. By way of example, for a 9⁄12 roof at a span of 16 feet, the worker with a customary calculator would note the tabular data of 15 feet for a 12 foot span and calculate a required stock length of 20 feet, i.e. (15×16)/12. The typical worker would be able to readily adjust the stock length for overhangs, setoffs, ridges and the like.

The framing square 10 as hereinabove described may be used for framing as illustrated in FIGS. 6 and 7. For transverse measuring or scribing of a workpiece 100, the framing square 10 is positioned with the crossbar 14 at a longitudinal edge and slid therealong to a desired location. In this position, the scale body 12 is at a right angle to the workpiece 100 and a transverse line may be transcribed at the outer edge, 18 or the inner edge 102. The framing square may be moved for scribing additional setoffs or 2× increments.

For ridge cuts or birdsmouth cuts used in rafters, the pitch indicia 70 are employed. After selecting a rafter length using the above-described tabular data, the ridge angle for instance may be marked. The worker positions the pivot point 20 at a selected longitudinal position, and rotates the ruler section thereabout until the desired pitch angle on the indicia 70 is coincident with the lower longitudinal surface of the workpiece 100. The cut angle may be scribed along the inner edge as at 24. If a set-off for the ridge beam is required, a line 110 may be transcribed from the outer edge, or a partial pet-off may be scribed in parallel using the width indicia 62.

Similarly at the outer end of the rafter the framing notch or "birdsmouth" notch may be conveniently marked. At the length determined using the tabular data 80, the length from the ridge to the side of the notch is marked, the framing square placed at correct pitch and an appropriate line inscribed. The scale body 12 is then positioned perpendicular to the line 110 until a base cut line 112 of appropriate length for the applicable building standards is attained, usually a minimum of 1½ inches, and then marked for cutting. The overhang section 120 may also be marked in accordance with the above for proper length and angularity.

From the foregoing, it will be appreciated that the framing square of the present invention readily permits a worker using commonly available tools to accurately layout all common cuts and lengths, on the ground or on the structure, with an easy to carry, light weight tool devoid of superfluous information.

While the present invention has been described with reference to a preferred construction, other modifications thereto will become apparent. According, the scope of the invention should be determined only in accordance with the appended claims.

What is claimed:

1. A multi-purpose framing square for dimensional lumber comprising:

an elongate rectangular body having parallel inner and outer longitudinal sides, parallel top and bottom surfaces, and parallel planar faces, the width between said longitudinal sides corresponding to a standard width of the dimensional lumber; a cross member attached transversely to said bottom surface of said body, said cross bar having a width greater than the distance between said planar faces and having a proximate end terminating at said outer longitudinal surface of said body and a distal end extending beyond said inner longitudinal surface of said body, the inner edge of said proximate end establishing a pivot point for rotating said body member relative to said dimensioned lumber; first indicia means on at least one of said planar surfaces adjacent said inner longitudinal surfaces in the form of radial lines having said pivot point as an origin and incrementally spaced according to common pitches for said dimensional lumber for establishing a desired angularity between said longitudinal surfaces of said body and said dimensional lumber; second indicia means on said planar surfaces adjacent one of said longitudinal surfaces of said body and incrementally spaced therealong for establishing point to point distances on said dimensional lumber; and third indicia means on said planar faces adjacent said top ends of said body incrementally spaced therealong for establishing point to point distances on said dimensional lumber.

2. The multi-purpose framing square as recited in claim 1 wherein tabular means are provided on at least one of said planar surfaces of said body member for designating the length of a rafter member for a pitch associated with said dimensional lumber.

3. The multi-purpose framing square as recited in claim 1 wherein said dimensional lumber is 2× dimensional lumber and said distance between said longitudinal surfaces of said body is at least a 2× integer.

4. The multi-purpose framing square as recited in claim 1 wherein said second indicia means is in the form of a numbered scale.

5. The multi-purpose framing square as recited in claim 4 wherein said second indicia means on one planar face has an origin adjacent said base end of said body and said second indicia means on said other planar face has an origin adjacent said top end of said body.

6. The multi-purpose framing square as recited in claim 4 wherein said third indicia means is the form of common increments of said dimensional lumber.

7. The multi-purpose framing square as recited in claim 6 wherein said third indicia means on one planar face has an origin adjacent one longitudinal surface of said body and said third indicia means on said other planar face has an origin adjacent said other longitudinal surface of said body.

8. A multi-purpose framing square for 2× dimensional lumber comprising:

an elongate rectangular body having parallel inner and outer longitudinal sides, parallel top and bottom surfaces, and parallel planar faces, the width between said longitudinal sides corresponding to said dimensional lumber; a transverse crossbar centrally laterally fixedly attached transversely to said bottom surface of said body, said cross bar having a width greater than the thickness of said rectangular body, said crossbar having one end terminating at said outer longitudinal surface of said body and the other end extending beyond said inner longitudinal surface of said body, the inner edge of said one end establishing a pivot point for rotating said body member relative to said dimensioned lumber; first indicia means on said planar surfaces adjacent said inner longitudinal surfaces in the form of radial lines having said pivot point as an origin and incrementally spaced according to common pitches for said dimensional lumber for establishing a desired angularity between said longitudinal surfaces of said body and said dimensional lumber; second indicia means on said planar surfaces adjacent said outer longitudinal surfaces of said body and incrementally spaced therealong for establishing point to point distances on said dimensional lumber wherein said second indicia means on one planar face has an origin adjacent said base end of said body and said second indicia means on said other planar face has an origin adjacent said top end of said body; and third indicia means on said planar faces in the form of common increments of said dimensional lumber, said third indicia means formed adjacent said top ends of said body and incrementally spaced therealong for establishing point to point distances on said dimensional lumber, and tabular means are provided on at least one of said planar surfaces of said body member for designating the length of a rafter member for a pitch associated with said dimensional lumber.

* * * * *